US006149396A

United States Patent [19]

Bassani

[11] Patent Number: 6,149,396

[45] **Date of Patent: *Nov. 21, 2000**

[54] APPARATUS FOR SEQUENTIALLY DISPENSING FLOWABLE MATERIALS

[75] Inventor: Lavinio Bassani, Montreal, Canada

[73] Assignee: Capmatic Ltd., Quebec, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/999,063

[22] Filed: Dec. 16, 1997

Related U.S. Application Data

[63] Continuation of application No. 08/436,922, May 9, 1995, abandoned.

[51] Int. Cl.[7] ..... F04B 49/00

[52] U.S. Cl. ..... 417/218; 222/309

[58] Field of Search ..... 417/212, 218; 92/165 R; 74/833, 54, 53; 464/182; 222/304; 180/14

[56] References Cited

U.S. PATENT DOCUMENTS

| | | | |
|---|---|---|---|
| 11,549 | 8/1854 | Ellis | 92/107 |
| 2,696,174 | 12/1954 | Cozzoli | 417/399 |
| 2,925,780 | 2/1960 | Tear | 417/517 |
| 3,311,065 | 3/1967 | Hager | 92/13.7 X |
| 3,557,892 | 1/1971 | Burrough | 180/14 |
| 3,798,982 | 3/1974 | Lundquist | 92/13.7 X |
| 3,871,268 | 3/1975 | Misima | 92/13.3 |
| 3,951,574 | 4/1976 | Panuline | 92/13.7 X |
| 4,234,107 | 11/1980 | Gernlein | 92/13.7 X |
| 4,275,822 | 6/1981 | Joffa . | |
| 4,281,777 | 8/1981 | Akens . | |
| 4,286,732 | 9/1981 | James . | |
| 4,334,437 | 6/1982 | Andersson | 74/53 |
| 4,494,677 | 1/1985 | Falcoff . | |
| 4,576,064 | 3/1986 | Kentfield | 74/833 |
| 4,869,397 | 9/1989 | Corniea . | |
| 5,022,556 | 6/1991 | Dency . | |
| 5,062,555 | 11/1991 | Whigham . | |
| 5,127,547 | 7/1992 | Gerich . | |
| 5,348,585 | 9/1994 | Weston . | |

FOREIGN PATENT DOCUMENTS

| | | |
|---|---|---|
| 495182 | 8/1950 | Belgium . |
| 679529 | 2/1964 | Canada . |
| 2463919 | 2/1981 | France . |
| 250626 | 10/1987 | Germany . |
| 437912 | 12/1971 | U.S.S.R. . |
| 467237 | 7/1975 | U.S.S.R. . |
| 540156 | 12/1976 | U.S.S.R. . |
| 853401 | 8/1981 | U.S.S.R. . |
| 1062529 | 12/1983 | U.S.S.R. . |
| 8200753 | 3/1982 | WIPO . |

OTHER PUBLICATIONS

Filab, *The effective way* . . . brochure date unknown.
H.G. Kalish, Inc., *Bottle Cleaners* brochure 1992.
H.G. Kalish, Inc., *Fillit gear pump filler* brochure 1994.
*Capmatic Ltd., Automatic Fillers* brochure date unknown.
Capmatic Ltd., *An Advanced Technologic* . . . brochure date unknown.
Capmatic Ltd., *Patriot Monoblock* brochure date unknown.

*Primary Examiner*—Timothy S. Thorpe
*Assistant Examiner*—David J Torrente
*Attorney, Agent, or Firm*—Schweitzer Cornman Gross & Bondell LLP

[57] ABSTRACT

Apparatus for sequentially dispensing flowable materials including a positive displacement metering-pump operated by an actuator capable of reciprocating pivotal movement within a range having an angular extent less than 180°. A link member connects the pivotal actuator to the plunger of the positive displacement pump for causing the pump to dispense liquid when the pump actuator is operated. The pump stroke adjuster can selectively vary the distance between the link member and the pivot axis of the pump actuator for, in turn, controlling the stroke of the pump.

16 Claims, 3 Drawing Sheets

APPARATUS FOR SEQUENTIALLY DISPENSING FLOWABLE MATERIALS

This application is a continuation of U.S. patent application Ser. No. 08/436,922 filed May 9, 1995, now abandoned.

FIELD OF THE INVENTION

The invention relates to an apparatus for repeatedly dispensing precise amounts of flowable materials, utilising a positive displacement metering pump. The stroke of the pump can be automatically controlled to regulate the amount of material delivered at each dispensing cycle.

BACKGROUND OF THE INVENTION

Automatic container filling machines commonly available in the industry utilize positive displacement pumps to sequentially deliver precise amounts of liquid. The pump assembly has an elongated cylindrical casing that receives a reciprocating plunger. During the pump fill stroke the plunger is displaced in the elongated casing to increase the void volume of the pump chamber and thus cause liquid to be admitted therein through an inlet port. To discharge the liquid, the direction of travel of the plunger is reversed. The liquid is expelled through an outlet port that is in fluid communication with the dispensing nozzle delivering the liquid to a bottle to be filled. Suitable check valves are provided in the inlet and the outlet ports to control the direction of liquid flow in accordance with the movement of the plunger.

An automatic filling machine commercialized by Capmatic Ltd., Montreal, Canada, under the brand name PATRIOT is an example of a sequential liquid dispensing device utilizing a bank of positive displacement pumps that are capable of filling several containers during each liquid dispensing cycle. Each pump is operated by a rotary actuator connected to the reciprocating plunger. The distance between the rotation axis of the actuator and the plunger extremity determines the pump stroke, hence the amount of liquid delivered by the pump. A precise micrometric screw allows to vary the distance at which the plunger is located with relation to the rotation axis of the actuator for making volume changes.

The drawback of this approach is the requirement to manually operate the micrometric screw for making the desired volume adjustments. Thus, the filling machine must be stopped every time changes to the dispensed volume are required. Such changes are performed between production runs when the filling machine is adjusted to process containers of different size. In other instances, small volume changes may need to be performed during a production run, particularly to fine tune the amount of liquid delivered at each dispensing cycle. With the prior art arrangement described above, the technician may need to stop the entire liquid packaging line several times until the precise volume setting has been found by trial and error. This may result in a significant amount of lost production.

OBJECT AND STATEMENT OF THE INVENTION

An object of the invention is an apparatus for sequentially dispensing predetermined amounts of a flowable substance which can be automatically adjusted to vary the volume of the flowable substance delivered at each dispensing cycle.

As embodied and broadly described herein, the invention provides a device for sequentially dispensing measured amounts of flowable material, said device comprising:

a positive displacement pump;

a pump actuator capable of reciprocating pivotal movement within a range having an angular extent less than 180 degrees;

a link member mounted to said pump actuator, said link member causing said positive displacement pump to dispense liquid when said pump actuator undergoes said reciprocating pivotal movement;

a pump stroke adjusting assembly for selectively varying a distance between said link member and a pivot axis of said pump actuator, said pump stroke adjusting assembly including:

a) a link actuator mounted to said pump actuator, said link member being connected to said link actuator, said link actuator being capable of displacing said link member relative said pivot axis when rotary movement is communicated to said link actuator; and b) a motor in driving relationship with said link actuator, whereby operation of said motor causes displacement of said link member relative said pivot axis for, in turn, altering a stroke of said positive displacement pump.

In a most preferred embodiment, the link actuator is in the form of a threaded rod rotatably mounted in the pump actuator. The link member is mounted to a connector threadedly engaged on the rod. When the rod is turned by the motor the position of the link member with relation to the pivot axis of the pump actuator changes, thus varying the pump stroke.

The motor is connected to the threaded rod by a drive shaft including universal joints to enable the transmission of the rotary movement irrespective of the angular position of the pump actuator.

The main advantage of this arrangement is the ability to perform liquid volume changes without the necessity of interrupting the operation of the filling machine.

As embodied and broadly described herein, the invention further provides a device for sequentially dispensing measured amounts of flowable material, said device comprising:

a positive displacement pump, including:

a) an elongated pump body;

b) a plunger mounted in said pump body for reciprocating sliding movement therein, a pump actuator capable of reciprocating pivotal movement within a predetermined angular range;

a link member mounted to said pump actuator, said link member causing said positive displacement pump to dispense liquid when said pump actuator undergoes said reciprocating pivotal movement;

a pump stroke adjusting assembly for selectively varying a distance between said link member and a pivot axis of said pump actuator, said pump stroke adjusting assembly including:

a) a linear actuator mounted to said pump actuator, said link member being mounted to said linear actuator, said linear actuator being capable of displacing said link member relative said pivot axis when rotary movement is communicated to said linear actuator; and b) an electric motor in driving relationship with said linear actuator, whereby rotation of said motor causes displacement of said link member relative said pivot axis for, in turn, altering a stroke of said positive displacement pump.

DESCRIPTION OF A PREFERRED EMBODIMENT

Figure 1:
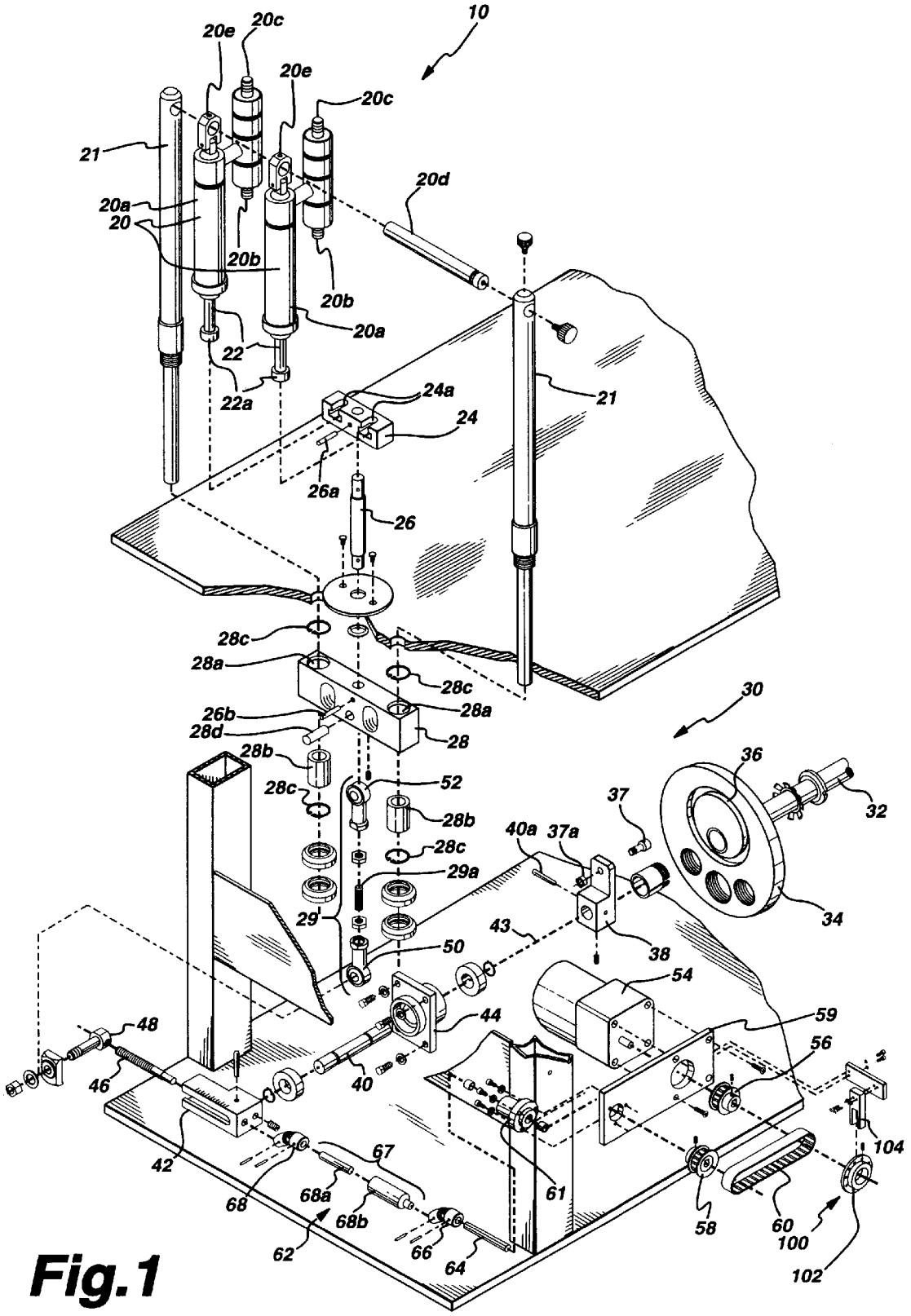
FIG. 1 is an exploded view of a pumping assembly constructed in accordance with the present invention.

FIG. 1 illustrates a pumping assembly, designated comprehensively by the reference numeral 10 that is designed to be used in an automatic filling machine. Such machine is employed in bottling plants to sequentially fill containers with flowable substances, such as shampoo, oil, water, cream or any other material having a pumpable consistency.

The pumping assembly 10 comprises a pair of positive displacement pumps 20 that are operated in tandem to supply respective nozzles (not shown) of the filling apparatus. Each pump comprises a cylindrical casing 20*a* defining an internal pumping chamber. A reciprocating plunger 22 is mounted in each casing 20*a* (the drawings illustrate only the plunger rods). When the plungers descend, the void volume of the owing chamber increases which causes fluid to be admitted through respective inlet ports 20*b*. The volume of liquid filling the pumps is expelled through outlet ports 20*c* when the plungers 22 are raised. The outlet ports 20*c* are connected to the liquid discharge nozzles (not shown) that deliver liquid to the individual containers to be filled. Appropriate check valves are mounted in the pathways of the inlet and outlet ports (20*b*, 20*c*) to direct the flow of liquid in accordance with the movement of the plungers 22.

The pumps 20 are suspended from a cylindrical horizontal bar 20*d* engaging eye connectors 20*e* secured to the upper extremities of the respective pump housings 20*a*. The horizontal bar 20*d* is secured to a pair of vertical rods 21 that are mounted to the frame of the apparatus (not shown in the drawings). The plungers 22 are displaced up and down by the intermediary of a block 24 having a generally rectangular configuration. A quick connect style coupling between the plungers 22 and the block 24 is preferred to facilitate assembly/disassembly during maintenance and cleaning procedures. At this end, the lower extremity of each plunger 22 is provided with a disc-shaped head 22*a* releasably engaging a U-shaped mating recess 24*a* formed on the block 24.

The block 24 is connected to a linear displacement block 28 by the intermediary of a short cylindrical rod 26. The extremities of the rod 26 fit in respective cylindrical bores formed in the blocks 24 and 28 and they are secured therein by dowel pins 26*a* and 26*b*, respectively.

The linear displacement block 28 is slidingly mounted on the vertical rods 21 that support and guide its reciprocating movement. The block 28 includes cylindrical bores 28*a* formed near its longitudinal extremities receiving linear bearings 28*b* held captive by locking rings 28*c*. The linear bearings 28*b* engage the lower section of the vertical rods 21 that are machined to provide a smooth finish for a friction-free up and down displacement.

The linear displacement block 28 is connected to an actuator member 42 by the intermediary of a link member 29. The latter includes an upper ball joint 52 pivotally connected to the linear displacement block 28 by a pin 28*d*. A lower ball joint 50 pivotally connects with the actuator 42 as it will be described hereinafter. The ball joints 52 and 50 are united by a short threaded shank 29*a*.

The actuator 42 is capable of pivotal movement about a generally horizontal axis 43 within an angular range less than 180°. This pivotal movement is reciprocating to impart an alternate upper and lower displacement to the plungers 22 by the intermediary of link 29, linear displacement block 28, rod 26 and finally block 24. The actuator 42 carries an elongated threaded rod 46 on which is threadedly engaged a bolt 48. The lower ball joint 50 or the link 29 is pivotally mounted on the shank of the bolt 48 and secured therein by a nut 49. Note that the threaded rod 46 is locked against translational movement in the actuator 42, and it is only capable to rotate therein. This rotation causes a linear displacement of the bolt 48 with relation to the pivot axis 43.

A reciprocating pivotal movement in imparted to the actuator member 42 by a drive assembly designated comprehensively by the reference numeral 30. The drive assembly 30 comprises a rotating drive shaft 32 to which is connected a disc 34. On the face of the disc 34 which is opposite to the drive shaft 32 is machined a circular groove 36 that is eccentric to the rotation axis of shaft 32 and thus forms a cam. The cam 36 receives a cam follower 37 connected to the extremity of an L-shaped member 38. The cam follower 37 is a round headed screw secured to the L-shaped member 38 by means of a nut 37*a*. The L-shaped member 38 is secured by a dowel pin 40*a* to the extremity of a shaft 40 that extends along the horizontal pivot axis 43. The other extremity of the shaft 40 is rigidly connected to the actuator 42. The assembly is supported for pivotal movement in a bearing 44 that is secured to the frame of the machine (not shown in the drawings).

Figure 2:
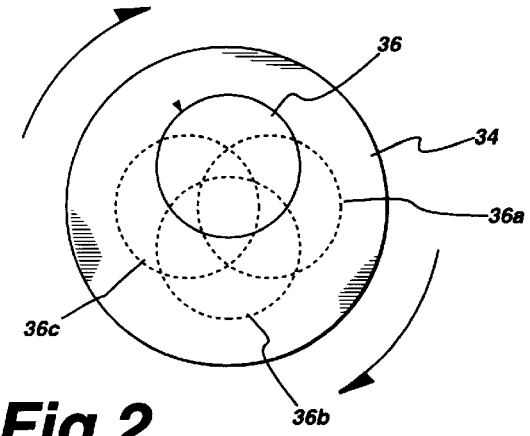
FIG. 2 is a plan view of a disc on which is formed a cam, the cam being shown in different positions as the disk is rotated by 90 degree increments.

The cam 36 and the L-shaped member 38 are designed to convert the rotary movement of disc 34 to an alternating pivotal movement over an angular range less than 180° that is communicated to the actuator 42. FIG. 2 illustrates the position of the cam 36 as the disc 34 is turning in the clockwise direction. When the disc 34 is at a 0 degree position, the cam is depicted in solid lines. The cam is represented with dashed lines in alternate positions 36*a*, 36*b* and 36*c* that are observed as the disc 34 is rotated by 90° increments.

Figure 3:
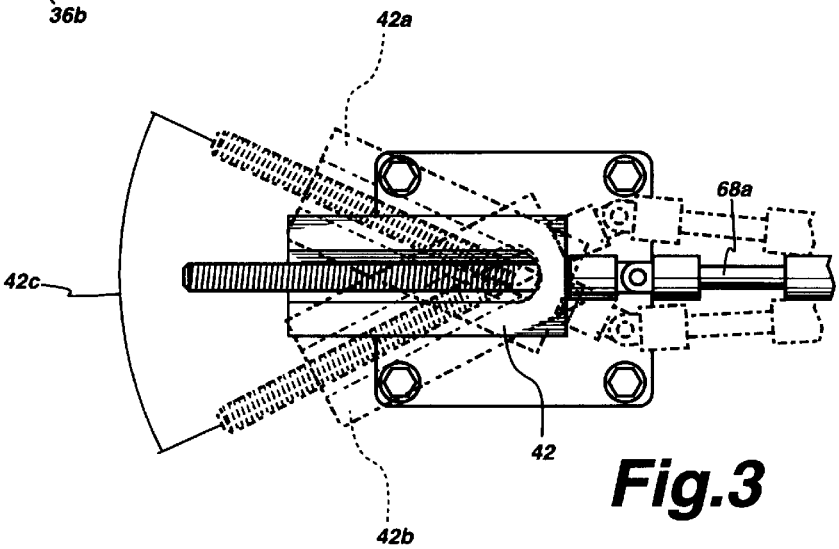
FIG. 3 is a schematical view illustrating the pivotal movement of a pump actuator.

The movement of the actuator 42 caused by the continuous clockwise rotation of the disc 34 is depicted in FIG. 3. As the disc 34 rotates over 180°, the actuator 42 pivots through an arc circle 42*c* having an annular extent of less than 180°. Continuous rotation of the disc 34 from the 180° to the 360° position causes the actuator 42 to sweep again the entire angular range 42*c* but in the opposite direction. Thus, when the disc 34 effects half a turn the actuator 42 pivots in the-counter-clockwise direction to displace the plungers down by the intermediary of link 29, linear displacement block 28, rod 26 and block 24 in order to effect a pump filling cycle. During the following half-turn of the disc 34 the actuator 42 pivots in the clockwise direction for raising the plungers 22 and thus expel the liquid accumulated in the pumping chambers.

Figure 4:
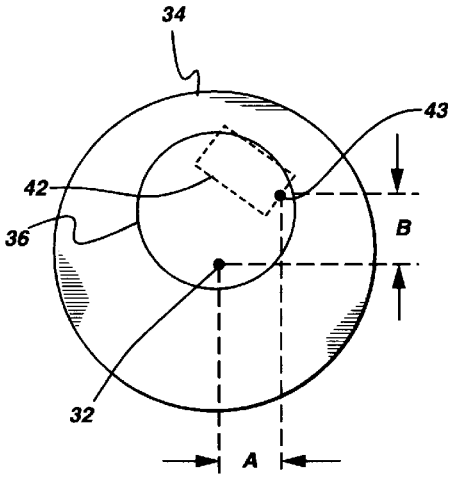
FIG. 4 is a plan view of the disk shown in FIG. 2, illustrating the pump actuator in one possible spacial position that it can acquire during the operation of the pumping assembly.

In a most preferred embodiment, the cam 36 has an outer diameter of 157.1 mm and an inner diameter of 112.5 mm. The center of the cam 36 is located at a distance of 31.9 mm from the rotation axis of disc 34. The dimensions of the L-shaped member 38 are such that the cam follower 37 is at a distance of 60 mm from the pivot axis 43. This geometric relationship causes the actuator 42 to move through an angular range 42*c* of 56 degrees as the disc 34 is rotating. FIG. 4 of the annexed drawings illustrates the relative positions of the axes 43 and 32. The axis 43 about which the pump actuator pivots is displaced relative to the axis 32 by A (53 mm) to the right and by B (66 mm) upwardly. As a result, the pump actuator 42 (shown in dashed lines) is inclined to the left.

The stroke of pumps 20 can be dynamically controlled by a pump stroke adjusting assembly 55 50 while the actuator 42 is being operated. The pump stroke adjusting assembly 55 comprises an electric motor 54 driving a sprocket 56 which drives a corresponding sprocket 58 by the intermediary of a cogged belt 60. The sprockets 56 and 58 are mounted in suitable bearings (not shown in the drawings) that are supported in a vertical plate 59 forming part of the machine frame. Note that the electric motor 54 is also attached to the plate 59.

The sprocket 58 drives a hub 61 that is connected to the threaded rod 46 by the intermediary of a drive shaft assembly that includes a first rigid shaft segment 64 connected to a first universal joint 66, connected to a telescopic shaft segment 67, connected to a universal joint 68 which, in turn, is rigidly connected to the extremity of the threaded rod 46. The universal joints 66 and 68 allow the rotary movement imparted to the hub 61 to be transmitted to the threaded rod 46 irrespective of the angular position of the actuator 42. The telescoping shaft segment 67 allows a limited degree of expansion/compression movement within the drive shaft assembly that is required due to the pivotal movement of the actuator 42. The telescopic shaft 67 comprises a splined member 67*a* received in a conforming centrally extended cavity (not shown) in a second member 67*b*. This feature enables to move members 67*a* and 67*b* one relative to the other along a common centerline.

Figure 5:
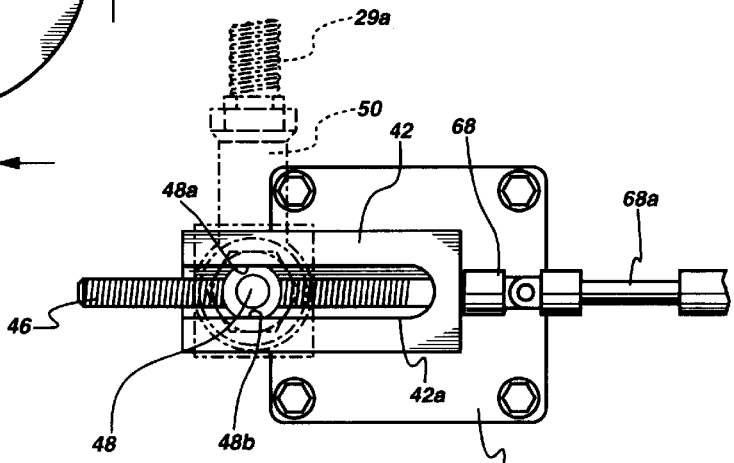
FIG. 5 is an enlarged view of a pivotal pump actuator, some parts being omitted for clarity.
Figure 6:
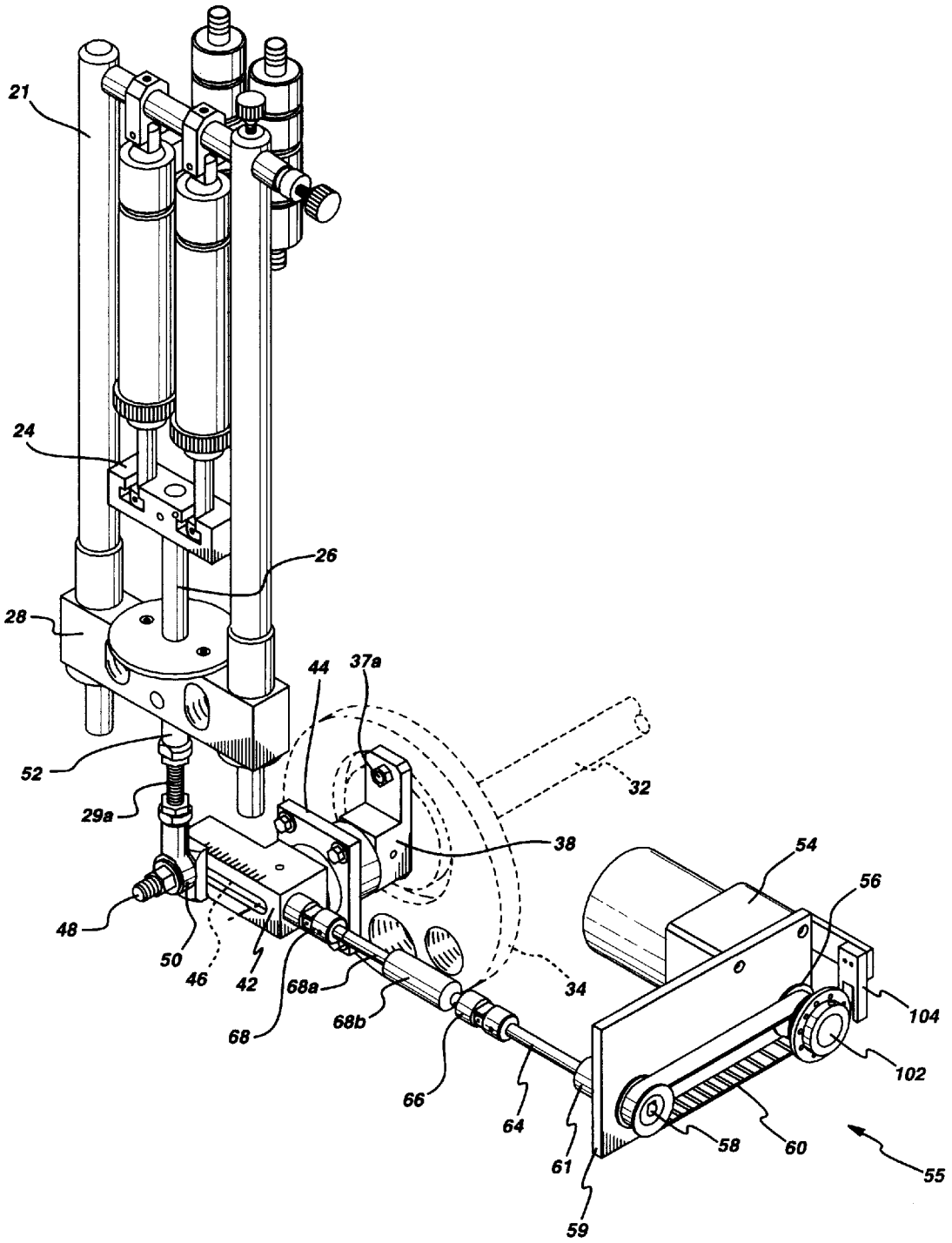
FIG. 6 is an isometric view of the pumping assembly of FIG. 1.

FIG. 5 is an enlarged elevational view of the actuator 42, showing the threaded rod 46 and the bolt 48 engaged thereon. The lower ball joint of the link 29 that is mounted on the shank of the bolt 48 is omitted for clarity. The actuator member 42 is provided with an elongate U-shaped recess 42*a* in which is received the threaded shaft 46. The non-threaded extremity of the shaft passes through a circular aperture on the actuator 42 and connects with the universal joint 68. The head of the bolt 48 is machined to provide two flat opposite surfaces 48*a* and 48*b* spaced by a distance slightly less than the transverse dimension between the sides of the U-shaped recess 42*a* so as to enable the bolt head to slide in the U-shaped cavity 42*a*. It will be apparent that when the universal joint 68 is turning, the bolt 48 is displaced longitudinally so as to vary the position of the ball joint 50 with relation to the pivot axis 43. This dynamically controls the stroke of the pump without any need to stop the operation of the filling machine.

Most preferably, the adjustment of the pump stroke is effected under microprocessor control that determines the direction of rotation of the motor 54 (to increase or decrease the stroke) as well as the number of turns the motor should effect (the magnitude of the change). Information as to the position of the motor shaft is supplied to the microprocessor by a sensor 100 which is in the form of a disc provided with a plurality of equispaced apertures 102 around its periphery. A U-shaped sensor element 104 receives the disc. One of the legs of the U-shaped structure 104 carries a light source (not shown in the drawings) while the other leg is provided with a suitable light detector (not shown in the drawings). When an aperture 102 lines up with the light transmission path between the source and the detector, an output signal is generated. Thus, by counting the number of pulses observed on the output of the sensor 100, the micro-processor is able to determine precisely the position of the motor shaft to ensure accurate control of the pump stroke.

The above description of the present invention should not be interpreted in any-limiting manner as refinements and variations are possible without departing from the spirit of the invention. The scope of the invention is defined in the appended claims and their equivalents

I claim:

1. A device for sequentially dispensing measured amounts of flowable material, said device comprising:

a positive displacement pump;

a pump actuator capable of reciprocating pivotal movement within a range having an angular extent less than 180 degrees;

a link member mounted to said pump actuator, said link member causing said positive displacement pump to dispense liquid when said pump actuator undergoes said reciprocating pivotal movement;

a pump stroke adjusting assembly for selectively varying a distance between said link member and a pivot axis of said pump actuator, said pump stroke adjusting assembly including:

a) a link actuator mounted to said pump actuator, said link member being connected to said link actuator, said link actuator being capable of displacing said link member relative said pivot axis when rotary movement is communicated to said link actuator; and b) a motor in driving relationship with said link actuator, whereby rotation of said motor causes displacement of said link member relative said pivot axis for, in turn, altering a stroke of said positive displacement pump, said motor being operative to cause displacement of said link member independently of the reciprocating pivotal movement of said pump actuator.

2. A device as defined in claim 1, wherein said link actuator is a linear actuator for causing displacement of said link member along a generally straight line.

3. A device as defined in claim 2, wherein said linear actuator includes:

a) an elongated threaded rod;

b) a coupling member connected to said link member, said coupling member being threadedly engaged on said elongated threaded rod, said motor being in driving engagement with said elongated threaded rod, whereby rotation of said motor causes said coupling member to linearly travel on said threaded rod for altering the stroke of the pump.

4. A device as defined in claim 1 wherein said motor is connected to said link actuator by a transmission means, said transmission means being capable of communicating rotary movement to said link actuator at any angular position of said pump actuator within said range.

5. A device as defined in claim 4, wherein said transmission means includes a drive shaft.

6. A device as defined in claim 5, wherein said drive shaft includes a universal joint.

7. A device as defined in claim 5, wherein said drive shaft includes a pair of universal joints in a spaced apart relationship.

8. A device as defined in claim 5, wherein said drive shaft includes a telescopic shaft segment allowing said drive shaft to extend and to accommodate distance variations between said motor and said link actuator occurring when said pump actuator pivots.

9. A device as defined in claim 1, wherein said positive displacement pump includes:

a) cylindrical casing; and b) a plunger mounted in said pump casing for reciprocating movement therein, said plunger being operatively connected to said link member.

10. A device as defined in claim 9, further comprising a linear displacement block connecting said link member to said plunger.

11. A device as defined in claim 10, wherein said linear displacement block is slidingly mounted on a pair of vertical rods that guide said linear displacement block.

12. A device as defined in claim 1, comprising a rotary prime mover in driving relationship with said pump actuator.

13. A device as defined in claim 12, comprising a drive assembly connected between said rotary prime mover and said pump actuator, said drive assembly providing means for converting a rotary motion to a reciprocating pivotal movement having an angular range less than 180 degrees.

14. A device as defined in claim 13, wherein said drive assembly includes a cam.

15. A device as defined in claim 14, wherein said drive assembly includes a disk coupled to said rotary prime mover for rotation therewith, said disk including a generally circular recess eccentrically located on said disk, said recess forming said cam.

16. A device for sequentially dispensing measured amounts of flowable material, said device comprising:

a positive displacement pump, including:

a) a cylindrical casing;

b) a plunger mounted in said cylindrical casing for reciprocating sliding movement therein;

a pump actuator capable of reciprocating pivotal movement within a predetermined angular range;

a link member mounted to said pump actuator, said link member causing said positive displacement pump to dispense liquid when said pump actuator undergoes said reciprocating pivotal movement;

a pump stroke adjusting assembly for selectively varying the distance between said link member and a pivot axis of said pump actuator, said pump stroke adjusting assembly including:

a) a linear actuator mounted to said pump actuator, said link member being mounted to said linear actuator, said linear actuator being capable of displacing said link member relative said pivot axis when rotary movement is communicated to said linear actuator;

b) an electric motor in driving relationship with said linear actuator, whereby rotation of said motor causes displacement of said link member relative said pivot axis for, in turn, altering a stroke of said positive displacement pump, said motor being operative to cause displacement of said link member independently of the reciprocating pivotal movement of said pump actuator.

* * * * *

UNITED STATES PATENT AND TRADEMARK OFFICE

CERTIFICATE OF CORRECTION

PATENT NO. : 6,149,396
DATED : November 21, 2000
INVENTOR(S) : Lavinio Bassani

It is certified that error appears in the above-identified patent and that said Letters Patent is hereby corrected as shown below:

Claim 9,
Line 4, "said pump" should read -- said cylindrical".

Signed and Sealed this

Nineteenth Day of February, 2002

*Attest:*

*Attesting Officer*

JAMES E. ROGAN
*Director of the United States Patent and Trademark Office*